US008382400B2

(12) United States Patent
Powell

(10) Patent No.: US 8,382,400 B2
(45) Date of Patent: Feb. 26, 2013

(54) SANDBAG

(76) Inventor: John M. Powell, Folsom, CA (US)

( * ) Notice: Subject to any disclaimer, the term of this patent is extended or adjusted under 35 U.S.C. 154(b) by 345 days.

(21) Appl. No.: 12/460,116

(22) Filed: Jul. 14, 2009

(65) Prior Publication Data

US 2010/0014788 A1 Jan. 21, 2010

Related U.S. Application Data

(60) Provisional application No. 61/135,067, filed on Jul. 15, 2008.

(51) Int. Cl.
*E02D 17/20* (2006.01)

(52) U.S. Cl. ..... 405/284; 405/302.4; 405/302.7; 405/107

(58) Field of Classification Search ..... 405/115, 405/107, 302.4, 302.6, 302.7, 272, 282, 284, 405/19; 383/32, 907, 105
See application file for complete search history.

(56) References Cited

U.S. PATENT DOCUMENTS

| | | | | |
|---|---|---|---|---|
| 1,253,269 | A * | 1/1918 | Moeller | 383/37 |
| 3,003,681 | A * | 10/1961 | Orsini | 383/121 |
| 6,612,741 | B1 | 9/2003 | Horne | |
| 2002/0090265 | A1 * | 7/2002 | Merten | 405/18 |
| 2009/0047073 | A1 * | 2/2009 | Sprague et al. | 405/184.4 |
| 2009/0274519 | A1 * | 11/2009 | Shaw | 405/107 |

FOREIGN PATENT DOCUMENTS

| | | | |
|---|---|---|---|
| JP | 07-102540 | | 4/1995 |
| JP | 07-222541 | | 8/1995 |
| JP | 11-029151 | | 2/1999 |
| JP | 2001-039450 | | 2/2001 |
| JP | 2002021039 | * | 1/2002 |

* cited by examiner

*Primary Examiner* — Sean Andrish
(74) *Attorney, Agent, or Firm* — Heisler & Associates

(57) ABSTRACT

The bag has a trapezoidal shape including a pair of parallel edges opposite each other with one longer than the other and a pair of opposite diverging edges. One edge of the bag is defined by a fold to close off an opening providing access into the bag. Other edges of the bag are formed by a seam joining two opposite layers of flexible material together. The opening is preferably provided on a flap which extends beyond the trapezoidal perimeter of the bag. When this flap is folded over, the final trapezoidal shape for the bag is provided. Walls are built utilizing a plurality of such trapezoidally shaped sandbags in alternating parallel orientations for the long edges and short edges of adjacent bags. Joints between adjacent sandbags are longer than with rectangular sandbags and interlock together somewhat.

3 Claims, 3 Drawing Sheets

SANDBAG

CROSS-REFERENCE TO RELATED APPLICATIONS

This application claims benefit under Title 35, United States Code §119(e) of U.S. Provisional Application No. 61/135,067 filed on Jul. 15, 2008.

FIELD OF THE INVENTION

The following invention relates to sandbags and other media filled bags, such as those which can be used for forming walls out of granular media. More particularly, this invention relates to sandbags which have a trapezoidal shape to allow for the building of a wall with greater strength and water retention characteristics than with a standard rectangular bag.

BACKGROUND OF THE INVENTION

In the prior art, when walls need to be erected on a temporary basis, often such walls are formed by filling bags with sand and then stacking the bags to form the wall. For instance, when rivers or other bodies of water are threatening to flood, it is common that bags are filled with sand and levies are built by stacking the sandbags adjacent each other. If the sand were stacked without the bags, the sand would form a very broad low barrier and would be subject to the forces associated with the velocity of water acting on the sand. By containing the sand within bags, a wall which is taller and narrower at the base can be built and velocity forces of the water cannot act on individual sand granules and so the wall is stronger. Sandbags are also used for other purposes, such as to build walls in military applications, such as in building foxholes or other trenches or other infantry position reinforcements.

Prior art sandbags have a rectangular form with square corners, two longer opposing sides and two shorter opposing sides. Typically, one of the shorter opposing sides is open and is filled with sand. When the bags are stacked, these bags have joints therebetween which are provided along sides (typically short sides) of adjacent bags. These joints are generally perpendicular to a direction that the wall extends and have a length similar to a thickness of the wall being formed (or multiples of that thickness if a wall of multiple layers of bags is formed).

This prior art arrangement has numerous drawbacks. First, by orienting the joints between adjacent bags extending perpendicular to a thickness of the wall, the joints have a shortest possible length. When water is to be contained, one location of weakness is at the joint. By making the joint as short as possible, as with prior art sandbag walls, the greatest likelihood of water penetration exists.

Second, because the joints between adjacent bags extend perpendicular to the length of the wall, if excessively high forces are encountered by the wall, and the wall tends to bulge, nothing about this joint allows adjacent bags to work together to resist this bulging force. Furthermore, as bulging occurs, the joints open up further, encouraging water flow therethrough and further bulging and rupture of the wall. Accordingly, a need exists for lengthening this joint and orienting this joint in a way that causes the wall to have individual bags reinforce each other and resist water migration through the joints and strengthen the wall at the joints.

SUMMARY OF THE INVENTION

With this invention, a sandbag is provided which has a generally trapezoidal shape. Two diverging sides are provided opposite each other and two parallel sides are provided opposite each other. The diverging sides of a first sandbag are preferably located adjacent diverging sides of adjacent sandbags when a wall is built, but with every other bag reversed. In this way, a joint between adjacent bags is longer than a thickness of the wall. Also, if one of the bags starts to shift, it has a tendency to press against adjacent bags across the joint, so that the bags reinforce each other to effectively resist loads encountered by the wall.

The opening for filling the bag is preferably formed on a flap which extends from one of the sides of the sandbag, preferably the shorter one of the two parallel sides. This flap is folded over after the bag has been filled with sand and tucked under the bag. In this way, the weight of the bag helps keep the flap closed. Most preferably, the bag is formed from two separate layers including a top layer and a bottom layer. These layers are preferably similar in form and formed of a plastic material which can be heat welded about a perimeter to form the trapezoidal shape of the bag. One of the sides of this trapezoidal shape is formed by the fold between the flap and other portions of the bag.

The top layer and bottom layer are preferably formed of different colors so that patterns apparent in the building of the wall can provide quick information to supervisory personnel as to whether or not the wall is being properly built. For instance, if a common color is always on top and the short and long sides alternate, a repeating horizontal pattern is provided. If adjacent vertical courses are offset a common amount, diagonal lines of similar colors can be seen.

The plastic material is preferably textured to include ribs and spaces with the ribs defining thicker portions of the plastic than the spaces. Concentrating strength in the material in this fashion tends to more effectively add strength for containing the sand with a minimum of weight and material.

OBJECTS OF THE INVENTION

Accordingly, a primary object of the present invention is to provide a bag which can contain sand and be used in forming a wall of high strength.

Another object of the present invention is to provide a sandbag which is easy to fill with existing known tools and techniques.

Another object of the present invention is to provide a sandbag which is easy to carry.

Another object of the present invention is to provide a sandbag which can be readily stacked with other similarly shaped sandbags to form a high strength wall.

Another object of the present invention is to provide a method for building a sandbag wall which has high strength and resists leaks and bulging or other failure.

Another object of the present invention is to provide a sandbag and sandbag wall building system to maximize the effectiveness of sandbag levies and containment of bodies of water which are at flood stage.

Another object of the present invention is to provide a sandbag which is readily recyclable after use.

Other further objects of the present invention will become apparent from a careful reading of the included drawing figures, the claims and detailed description of the invention.

DESCRIPTION OF THE PREFERRED EMBODIMENT

Figure 4:
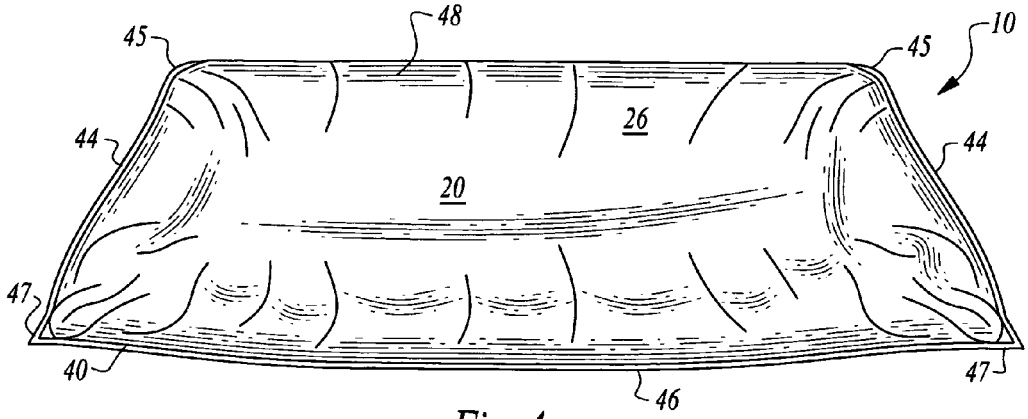
FIG. 4 is a top plan view of a filled sandbag according to a preferred embodiment of this invention.
Figure 5:
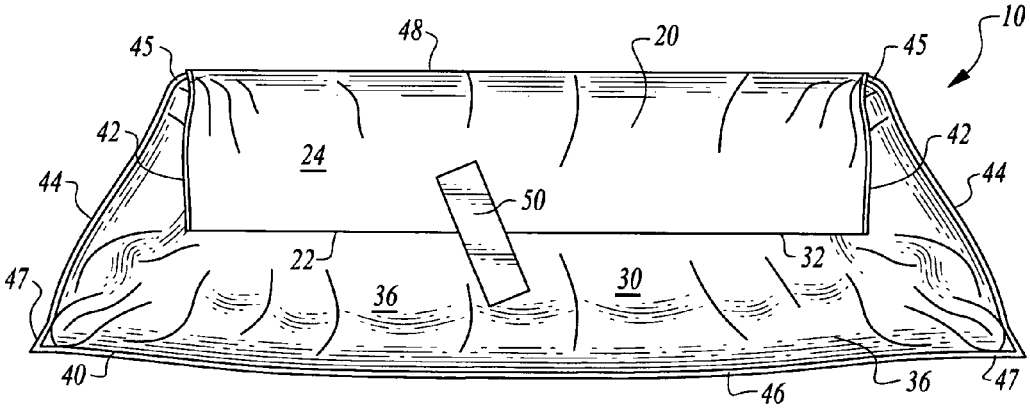
FIG. 5 is a bottom plan view of that which is shown in FIG. 4, and showing the option of using tape to close the flap.
Figure 6:
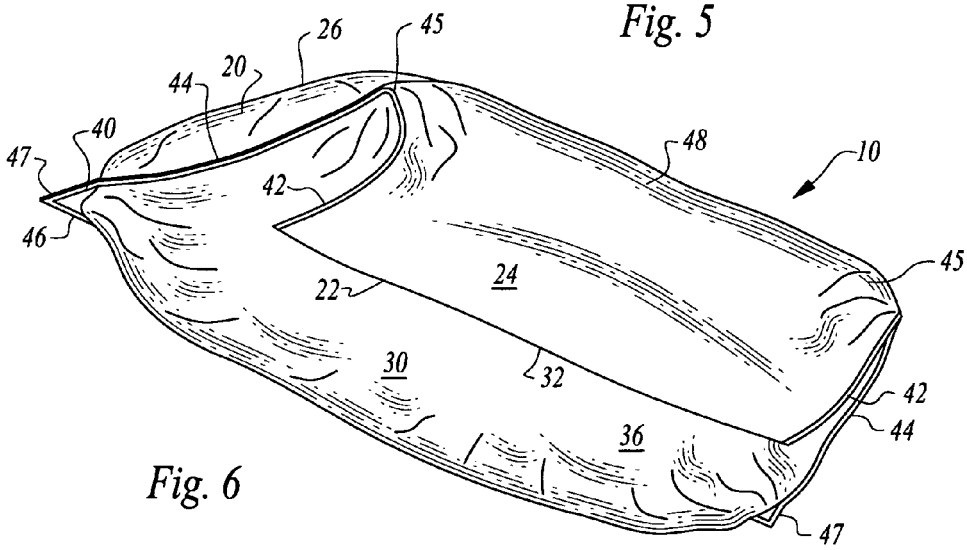
FIG. 6 is a perspective view of that which is shown in FIG. 4.

Referring to the drawings, wherein like reference numerals represent like parts throughout the various drawing figures, reference numeral 10 (FIGS. 4-6) is directed to a bag for containing sand S (FIG. 2) or other media, such as for use in the building of a wall 60 (FIGS. 7-9) or other structures. The bag 10 is filled, such as by pouring sand S from a tool T, such as a shovel (along arrow A of FIG. 3) and then a flap portion of the bag 10 including the opening 55 therein is folded over (along arrow B of FIG. 3) to close off the opening 55 and provide the completed bag 10 (FIGS. 4-6). The completed bag 10 has a unique trapezoidal shape to maximize interlocking strength and joint length when used in building walls or other structures of multiple such bags 10.

In essence, and with particular reference to FIGS. 1-6, basic details of the bag 10 of this invention are described according to a preferred embodiment. The bag 10 is preferably formed of two separate layers including a top layer 20 and a bottom layer 30. Each of these layers 20, 30 preferably have a similar perimeter shape (such as that depicted in FIG. 1). A seam 40 joins perimeters of the top layer 20 and bottom layer 30 together along most sides of the bag 10. However, an opening 55 (FIG. 3) is provided where no such seam is provided.

Most preferably, the layers 20, 30 are formed of a thin flexible plastic material which can be joined together by forming the seam 40 merely by heat welding the layers 20, 30 together. Tape 50 (FIG. 5) can optionally be provided to close a flap of the layers 20, 30 over itself to give the bag 10 its final trapezoidal shape.

Walls 60 of various different configurations can be constructed, typically by placing adjacent bags 10 with their diverging edges adjacent each other and with the bags 10 laid in an alternating pattern, such that joints 62 are provided between adjacent bags 10 in the walls 60. Multiple courses of bags 10 are typically provided, such as a first course 70 as a foundation layer and a second course 80 on top of the first course 70. Further courses are provided as required. Furthermore, a thickness of the wall 60 can be enhanced with additional inboard or outboard courses depending on the structural specifications for the wall 60.

Figure 1:
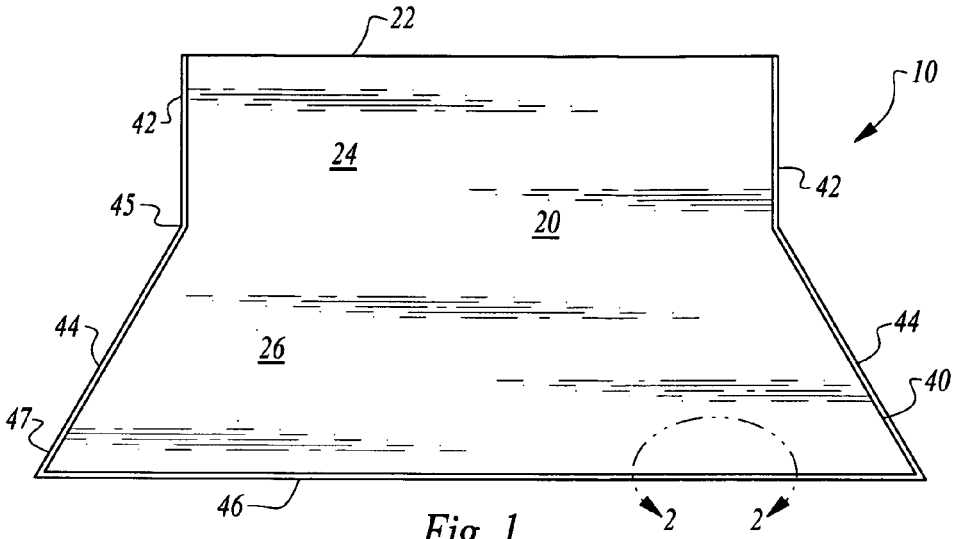
FIG. 1 is a top plan view of the bag of this invention before being folded to form the final trapezoidal shape for the sandbag, according to a preferred embodiment of this invention.
Figure 2:
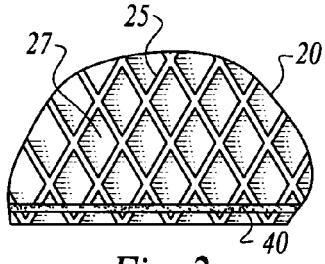
FIG. 2 is a detail of a portion of that which is shown in FIG. 1, revealing texture added to the material forming the bag in one form of this invention.
Figure 3:
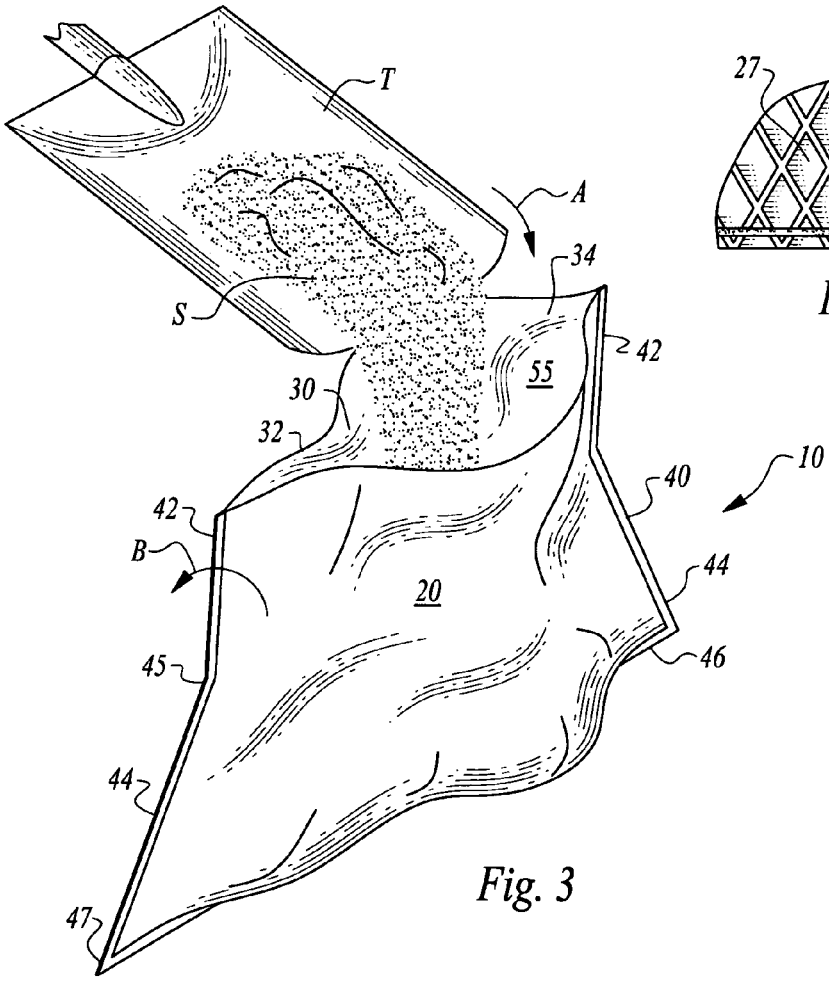
FIG. 3 is a perspective view of the sandbag of FIG. 1, according to one embodiment of this invention, in the process of being filled with sand or other media by a tool, such as a shovel.

More specifically, and with particular reference to FIGS. 1-3, particular details of the top layer 20 and bottom layer 30 are described, according to a preferred embodiment. In this preferred embodiment, the top layer 20 and bottom layer 30 preferably are substantially identical, except that most preferably they are formed of different colors of the same material. The top layer 20 and bottom layer 30 are aligned adjacent each other with similarly shaped edges of each layer 20, 30 adjacent each other.

These edges include a free edge 22 defining that portion of the top layer 20 which forms a portion of the opening 55. The bottom layer 30 also includes a free edge 32 forming a portion of the opening 55. Thus, the opening 55 is formed by the free edge 22 of the top layer 20 and the free edge 32 of the bottom layer 30.

The top layer 20 includes a flap portion 24 and a body portion 26. The flap portion 24 is configured so that it can be folded over the body portion 26 (arrow B of FIG. 3) after the bag 10 has been filled with sand S or other media (typically solid granular media). Similarly, the bottom layer 30 includes a flap portion 34 and body portion 36 with the flap portion 34 configured to be folded over the body portion 36 along with the flap portion 24 of the top layer 20.

With particular reference to FIG. 2, details of the material forming the layers 20, are described according to a preferred embodiment. In this preferred embodiment, the material forming the layers 20, 30 is a long chain polymeric hydrocarbon material, such as material from which plastic garbage bags are formed. The material is non-foraminous thin and flexible, having a thickness selected to provide the strength characteristics desired for the bag 10.

To enhance these strength characteristics without merely adding thickness to the material, most preferably the material is formed to include a plurality of ribs 25 and spaces 27. The ribs 25 define portions of the layers 20, 30 which are slightly thicker. The spaces define portions of the layers 20, 30 which are slightly thinner. By concentrating extra thickness within the ribs 25, and minimizing thickness within the spaces 27, strength is added to the material forming the layers 20, 30 with a minimum of material being required.

Also, the ribs 25 tend to disrupt the migration of small tears, so that minor defects in the bag 10 do not as readily lead to complete failure of the bag 10. While the ribs 25 and spaces 27 could have a variety of different shapes and configurations, most preferably the ribs 25 are linear in form and crisscross each other so that the spaces 27 have a generally diamond shaped appearance, with each of the diamonds being of similar size and shape in a regular pattern. In this way, relatively uniform strength is provided throughout the layers 20, 30.

The layers 20, 30 are joined together at a seam 40 which substantially follows an entire perimeter of the layers 20, 30 except where the free edges 22, 32 define the opening 55 (FIGS. 1-3). This perimeter includes two parallel edges 42 which are actually portions of the flap portion 24, 34. These parallel edges 42 transition into diverging edges 44 which are on opposite sides of the bag 10 and diverge away from each other. Where the parallel edges 42 transition into the diverging edges 44, obtuse corners 45 are provided. The obtuse corner 45 is a corner which has an angular measurement greater than 90°. The diverging edges 44 continue to the acute corners 47. The acute corners 47 define corners having an angular measurement of less than 90°. At the acute corners 47, the diverging edges 44 transition into the long edge 46. The long edge 46 is provided opposite a fold edge 48. The long edge 46 is defined as a portion of the seam 40, while the fold edge 48 defines the one edge of the bag 10 which is not formed by the seam 40, but rather is formed by folding (along arrow B of FIG. 3) of the flap portions 24, 34 of the layers 20, 30 over the body portions 26, 36 (FIGS. 5 and 6) to complete the generally trapezoidal shape for the bag 10 according to this preferred embodiment.

In this preferred embodiment, the two obtuse corners 45 preferably have similar angular measurement and the two acute corners 47 preferably have similar angular measurement. Most preferably, the obtuse corners have an angular measurement of 120°. Most preferably, the acute corners have an angular measurement of 60°. The diverging edges 44 have a length which is greater than a distance between the fold edge 48 and the long edge 46. This is in specific contrast to a standard rectangular sandbag which has short edges which are equal in length to a distance between long edges thereof.

While the diverging edges 44 preferably diverge at a common angle, it is conceivable that they could diverge at varying different angles which are either equal to each other or different from each other. The diverging edges 44 preferably each have a common length. The diverging edges 44 define a side of one of the joints 62 in a wall 60 of sandbags 10.

Tape 50 (FIG. 8) can optionally be utilized to keep the flap portion 24, 34 folded over the body portion 26, 36. However, most preferably the tape 50 is not utilized and the flap portion 24, 34 is merely held closed by placing it under the bag 10 as the bag 10 is stacked within a wall 60 (FIGS. 7-9).

Figure 7:
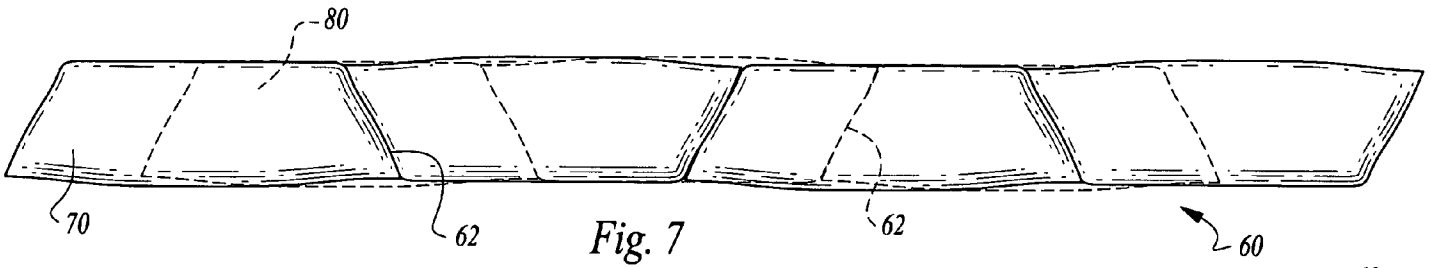
FIG. 7 is a top plan view of a sandbag wall with a first course shown in solid lines and second course shown in broken lines.
Figure 8:
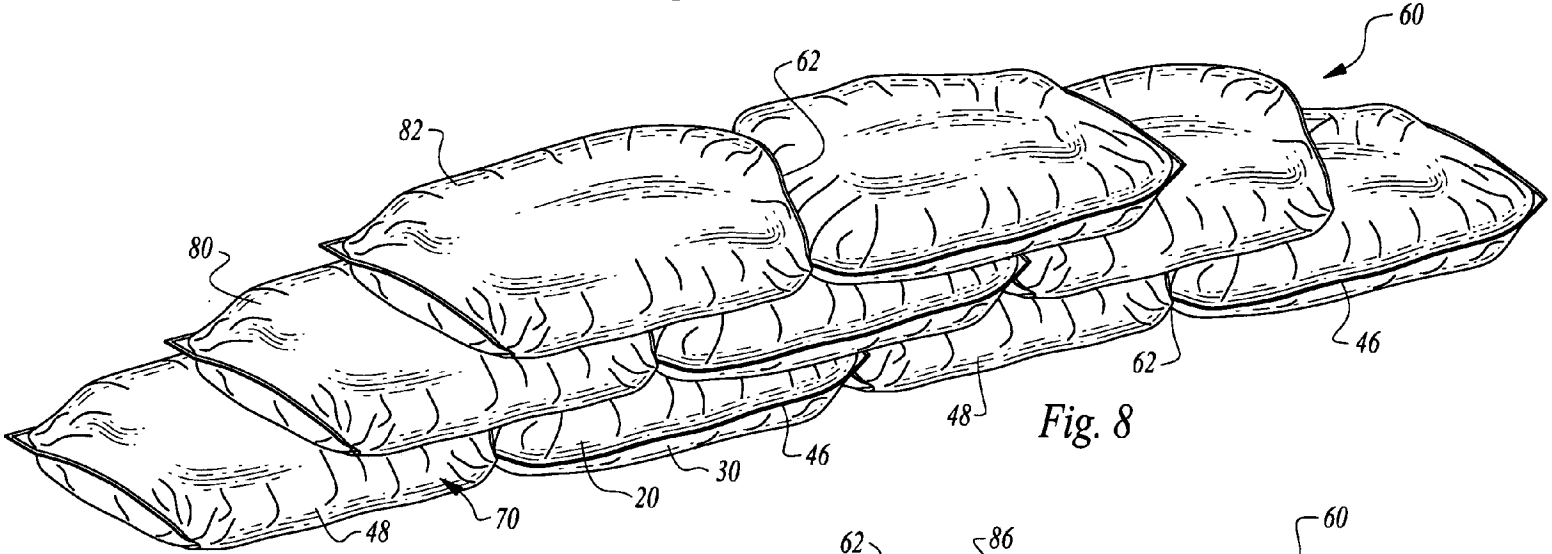
FIG. 8 is a perspective view of a sandbag wall built with sandbags such as those of the embodiment of FIG. 4.
Figure 9:
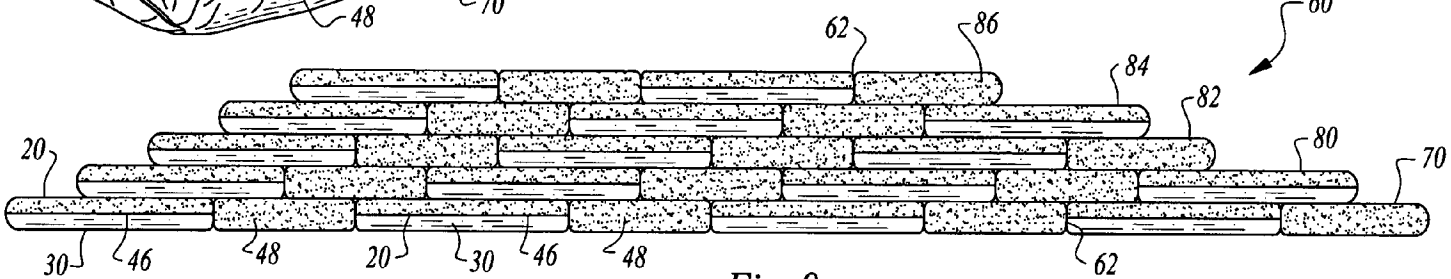
FIG. 9 is a front elevation view of a sandbag wall having been built with sandbags according to an embodiment of this invention, and with the pattern apparent from the building of such a wall shown when the sandbags are formed of top and bottom layers of different colors, and with heavy stipple depicting one color and unstippled regions depicting a second color.

With particular reference to FIGS. 7-9, details of walls 60 formed by the bags 10 of this invention are described. Walls 60 can be provided in a variety of different configurations. Generally, they include multiple courses, such as a first course 70 as a foundation layer, a second course 80 stacked upon the first course 70 and additional courses, such as a third course 82, fourth course 84 and fifth course 86 stacked sequentially on top of the first course 70. Joints 62 exist between adjacent bags 10 within each course. These joints 62 are not perpendicular to the front and rear of the wall 60, but rather are angled. Thus, the joints 62 are longer than they would be if the bags 10 were rectangular in form. Also, when loads are applied to the wall perpendicular to the wall 60, the portions of the bags adjacent the joints 62 tend to lock together and resist separation and expansion of the joints 62. A stronger wall 60 thus results.

Additional courses typically have their joints offset relative to the joints 62 of previous courses. This offsetting is preferably sufficient that no portions of the joints 62 overlap each other. If a wall 60 needs to have additional strength, additional lateral courses can be provided in front of or behind the first courses to add thickness to the wall.

When the top layer 20 and bottom layer 30 are formed of different colors, one edge defined as the fold edge 48 has a single color corresponding with the layer 20, 30 that is on the outside of the fold when the folding occurs (along arrow B of FIG. 3). Thus, the shorter fold edge 48 has a single color. In contrast, the long edge 46 shows the seam 40 and portions of both the top layer 20 and bottom layer 30 thereon. By constructing the wall 60 with a regular pattern of bags 10, a repeating pattern results. In this way, supervisors and inspectors of wall construction can quickly tell visually whether the wall has been constructed properly or not. Furthermore, workers can utilize this pattern to quickly tell whether the wall is being accurately built as it is being built, minimizing the potential for walls 60 being built with patterns that are not desired.

If a corner is to be formed in the sandbag wall, the diagonal edge can be utilized to be aligned with other diagonal edges to form a corner. Most preferably, the diagonal edge diverges from the longest edge of the sandbag by 60°. When two finished sandbags are placed with diagonal edges adjacent each other without alternating the orientation of the sandbags, a corner of approximately 60° results. Other angles could alternatively be utilized for the diagonal edges of the sandbag.

The bag 10 can have variable size. However, the diverging edges 44 are preferably not as long as the fold edge 48. The bag 10 is most preferably sized to hold 30-80 pounds of sand and is covered on at a time close to the body by holding the sandbag 10 close to the chest. Proportions shown in FIG. 1 are optional, but most preferred.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A method for building a wall, comprising in combination:

providing a plurality of sandbags, each of the sandbags including sand, a bag defining an enclosure for the sand, the bag having an opening into an interior of the enclosure, the bag having a trapezoidal shape when filled and closed with two opposite diverging sides and two opposite parallel sides, one of the parallel sides longer than the other; and laying the sandbags with the diverging sides of adjacent sandbags abutting each other and with the sandbags in a substantially common horizontal plane.

2. The method of claim 1 including the further step of alternating an orientation of the sandbags so that the long and short parallel sides of each sandbag are aligned together, with a long side of one sandbag adjacent short sides of adjacent sandbags.

3. The method of claim 1 including the further steps of:

forming said sandbags of a top layer and a bottom layer joined together at perimeters thereof;

forming the top layer and the bottom layer to be of different colors; and keeping a common color facing upward, and the flap folding downward and tucked under the bag, such that a regular color pattern will appear laterally as the wall is built; and offsetting joints between adjacent bags on a second course laid on top of a first course of multiple sandbags relative to joints between sandbags in the first course, such that joints between sandbags in adjacent courses are not aligned with each other.

* * * * *